US007392932B2

(12) United States Patent
Bostick, II

(10) Patent No.: US 7,392,932 B2
(45) **Date of Patent: *Jul. 1, 2008**

(54) FOLDABLE TRAY

(76) Inventor: Charles Robert Bostick, II, 833 W. 11th St., San Pedro, CA (US) 90731

( * ) Notice: Subject to any disclaimer, the term of this patent is extended or adjusted under 35 U.S.C. 154(b) by 228 days.

This patent is subject to a terminal disclaimer.

(21) Appl. No.: 11/316,472

(22) Filed: Dec. 22, 2005

(65) Prior Publication Data

US 2006/0131372 A1 Jun. 22, 2006

Related U.S. Application Data

(63) Continuation of application No. 10/903,639, filed on Jul. 30, 2004, now Pat. No. 7,007,838.

(60) Provisional application No. 60/491,619, filed on Jul. 31, 2003.

(51) Int. Cl.
*B65D 5/42* (2006.01)

(52) U.S. Cl. ..... 229/192; 229/189; 229/198; 229/198.1; 229/198.3

(58) Field of Classification Search ..... 222/460, 222/462, 566, 572; 141/337; D7/312, 316, D7/550.1, 554.3, 554.4; 294/26.5, 172
See application file for complete search history.

(56) References Cited

U.S. PATENT DOCUMENTS

| | | | | | |
|---|---|---|---|---|---|
| 57,024 | A | | 8/1866 | Wheat et al. | |
| 221,635 | A | * | 11/1879 | Wahl et al. | 222/572 |
| 922,334 | A | | 5/1909 | Regenstein | |
| 952,313 | A | * | 3/1910 | Droz | 141/98 |
| 1,050,407 | A | | 1/1913 | Verrette | |
| 1,210,127 | A | | 12/1916 | Wood | |
| 2,047,835 | A | * | 7/1936 | Prew | 294/172 |
| 2,200,320 | A | | 5/1940 | Zalkind | |
| 2,312,644 | A | | 3/1943 | Horr | |
| 2,530,009 | A | * | 11/1950 | Fields | 222/129 |
| 2,989,226 | A | | 6/1961 | Swartz | |
| 2,992,765 | A | | 7/1961 | Kram | |
| 3,226,008 | A | | 12/1965 | Chiorri | |
| 3,505,031 | A | * | 4/1970 | Perkinson et al. | 422/102 |
| 3,747,756 | A | * | 7/1973 | Wheeler | 209/703 |
| 3,774,835 | A | | 11/1973 | Monaghan | |
| 3,819,064 | A | * | 6/1974 | Chandler | 414/675 |
| 4,020,988 | A | | 5/1977 | Kipp | |
| 4,915,235 | A | | 4/1990 | Roosa | |
| 4,981,257 | A | | 1/1991 | Radbruch | |

(Continued)

*Primary Examiner*—Gary E Elkins
(74) *Attorney, Agent, or Firm*—Blakely Sokoloff Taylor & Zafman LLP

(57) ABSTRACT

A foldable tray having a single sheet of material having lines of reduced resistance to bending separating a central base area and first through fourth side areas encircling the base area, the lines of reduced resistance to bending separating the first and second side areas being curved away from each other adjacent a first corner of the base area to cause the base area adjacent the first corner to curve upward when the first and second side areas are bent upward along their respective lines of reduced resistance to bending, each side area having cooperatively disposed fasteners adjacent the adjacent side areas for retaining the side areas when folded upward about the lines of reduced resistance to bending. a tab with an opening may be provided integral with one of the side areas for hanging the tray for storage or display. Various embodiments are disclosed.

14 Claims, 3 Drawing Sheets

U.S. PATENT DOCUMENTS

D430,399 S * 9/2000 Pawuk ..... D3/313
6,196,426 B1 * 3/2001 White ..... 222/572
6,390,359 B1 5/2002 Lin
7,007,838 B1 * 3/2006 Bostick, II ..... 229/192

* cited by examiner

FOLDABLE TRAY

CROSS-REFERENCE TO RELATED APPLICATION

This application is a continuation of U.S. patent application Ser. No. 10/903,639 filed Jul. 30, 2004, now U.S. Pat. No. 7,007,838, which claims the benefit of U.S. Provisional Patent Application No. 60/491,619 filed Jul. 31, 2003.

BACKGROUND OF THE INVENTION

1. Field of the Invention

The present invention relates to the field of receptacles, and more specifically to trays.

2. Prior Art

A tray may be defined as a shallow flat receptacle with a raised edge or rim, used for carrying, holding, or displaying articles. The upturned edges give individual trays a significant height, which can be a disadvantage when it comes to storage of an empty tray. Also, even if identical trays nest, so that they may be stacked at the point of sale, they normally require shelf space, as there is no convenient way to hang them on a display. Also, conventional trays are rectangular, with all four corners being the same. However, in many applications, trays are used to temporarily hold small articles, or liquids, for easy access. When the remainder of the articles or liquid is to be returned to the original container, there is a risk of spillage if the remainder is poured directly from the tray to the original container. The present invention provides a novel tray having novel features that address such matters.

DETAILED DESCRIPTION OF THE PREFERRED EMBODIMENTS

The present invention comprises a foldable tray ideal for holding and pouring of small objects and powders, whether returning the same to their original container or to another container. By way of example, the preferred embodiment disclosed herein is intended for the hobby market to hold embossing powders, beads, glitter, confetti, metallic powders and the like. The foldable tray is also highly useful for other purposes such as for holding pills for counting or for holding other small items for sorting, counting, easy selection, etc.

Figure 1:
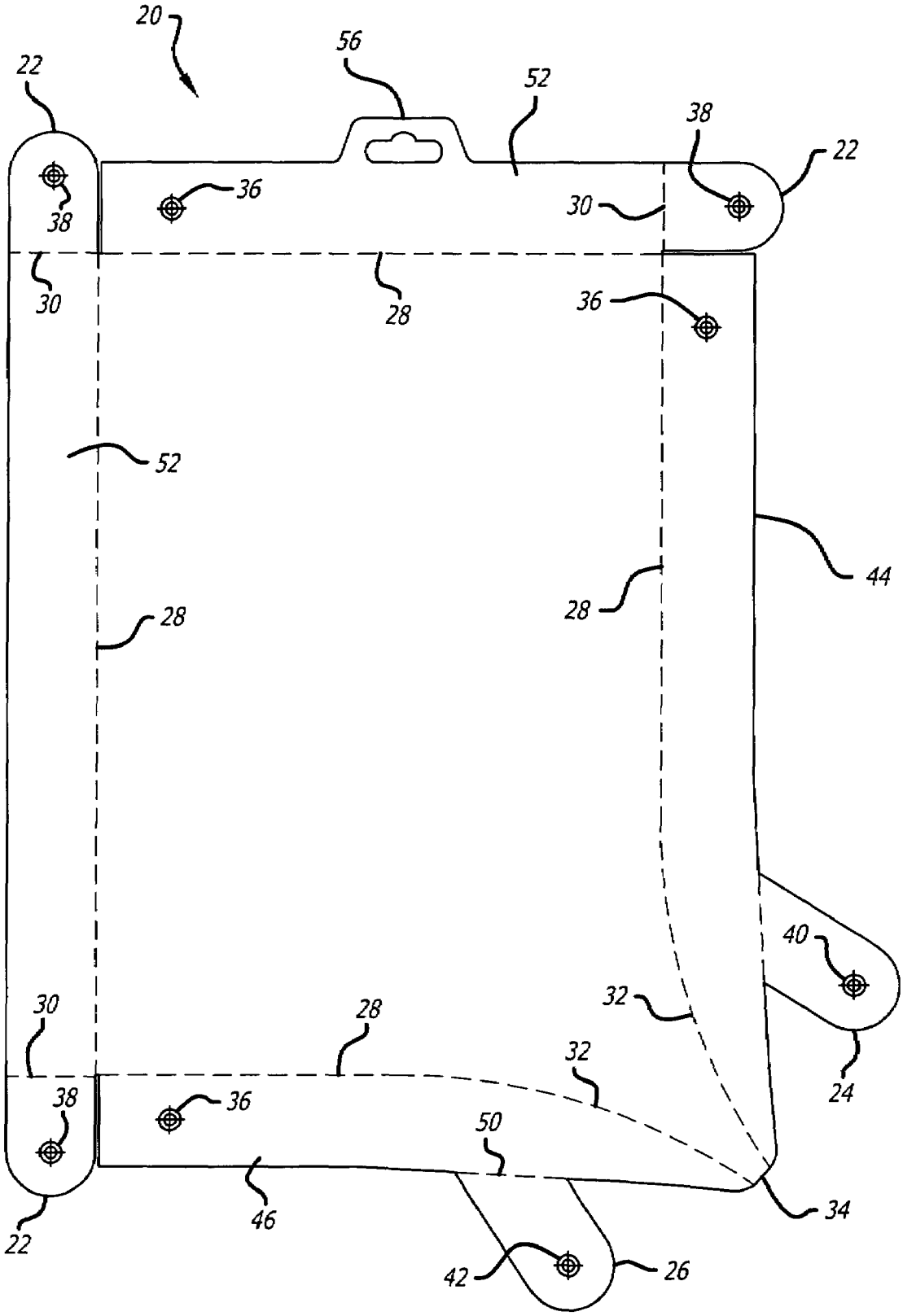
FIG. 1 is an illustration of one embodiment of an unfolded tray in accordance with the present invention.
Figure 2:
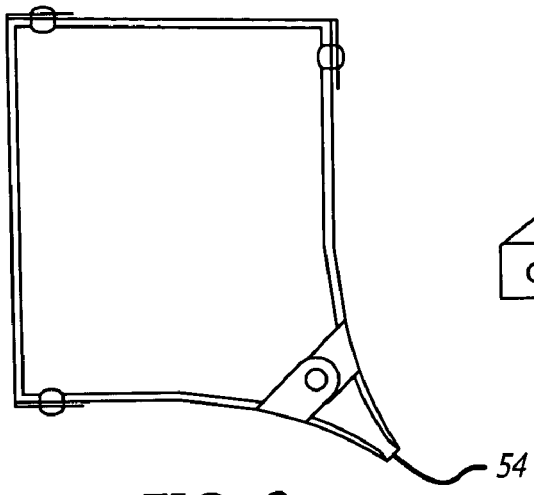
FIG. 2 is a top view of a folded tray in accordance with the present invention.
Figure 3:
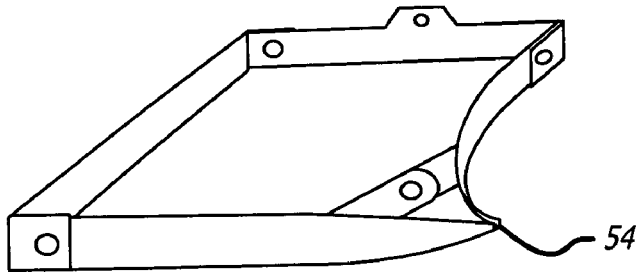
FIG. 3 is a front perspective view of a folded tray in accordance with the present invention.
Figure 4:
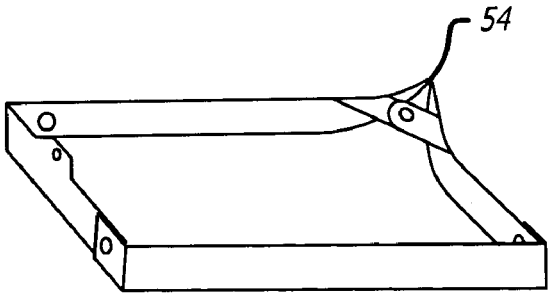
FIG. 4 is a left side perspective view of a folded tray in accordance with the present invention.
Figure 5:
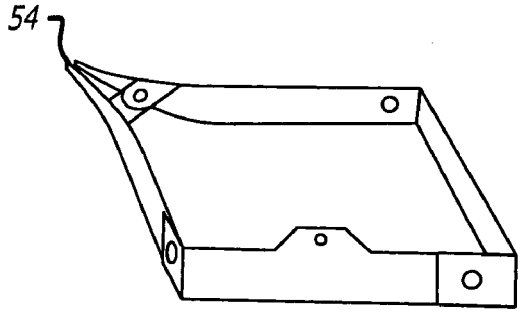
FIG. 5 is a back perspective view of a folded tray in accordance with the present invention.
Figure 6:
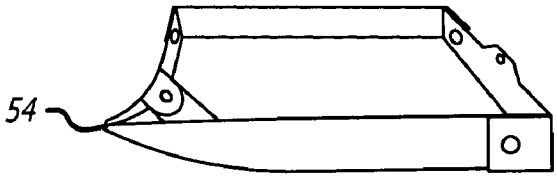
FIG. 6 is a right side perspective view of a folded tray in accordance with the present invention.
Figure 7:
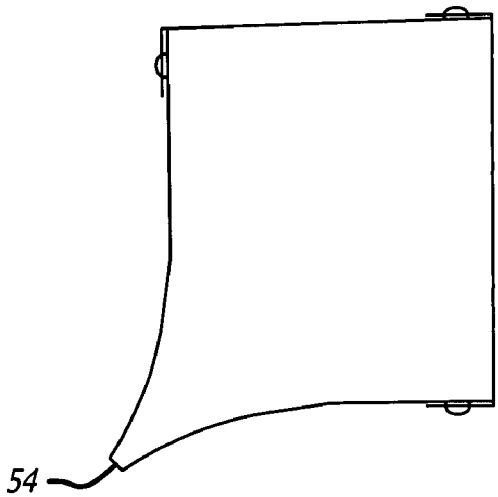
FIG. 7 is a bottom view of a folded tray in accordance with the present invention.

One embodiment of the foldable tray of the present invention is illustrated in the unfolded condition in FIG. 1. The tray is formed from a sheet of foldable, though semi-rigid, plastic such as, by way of example, polyethylene or polypropylene. These and other plastics, when in relatively thin sheet form, may be folded through a ninety degree angle many times before the material at the fold begins to separate.

The sheet of plastic, generally indicated by the numeral 20, is preferably die cut in the form shown to define an approximately rectangular form having end flaps 22 and tabs 24 and 26, though otherwise having an approximately rectangular outline. Also formed in the sheet 20 are fold lines 28 defined by lines of reduced resistance to bending. In the preferred embodiment, these lines are lines or regions of reduced material thickness. The fold lines 28 generally define a rectangular plane form, though at one corner curve in region 32 to intersect corner 34 of the plastic sheet 20. Fastened to the plastic sheet are complementary components of plastic snaps 36 and 38, and 40 and 42. In the exemplary embodiment, snap elements 36 are female or male snap elements facing downward and snap elements 38 are male or female snap elements facing upward. With respect to snap elements 40 and 42, either one may be a male snap element, with the other being a female snap element, the two snap elements facing in opposite directions.

To fold the tray, flaps 44 and 46 are folded upward along fold lines 28 to approximately ninety degrees, with tabs 24 and 26 being folded through another ninety degrees along fold lines 48 and 50 so that snap elements 40 and 42 may be snapped together (see FIGS. 2 through 7, illustrating a fully folded tray). Then the remaining two flaps 52 are folded upward and the tabs 22 folded around the outside of the adjacent flap and the snaps snapped together.

The resulting tray is illustrated in FIGS. 2 through 7. The curve of fold lines 28 in regions 32 provides an upward curving pouring spout 54 which prevents material in the tray from accidentally rolling or pouring out through the spout, but still allows easy pouring of the contents in the tray into another container, such as its original container.

It should be noted that any or all of tabs 22 may be on the end of the adjacent flap rather than on the flap shown in the illustration of FIG. 1. Also while the folded and assembled tray as shown in FIGS. 2 through 7 is shown with square tabs, this is for illustration convenience only, as preferably the tabs 22 are rounded as shown in FIG. 1 to avoid sharp corners. It is for this reason that the tabs are preferably folded around the outside of the adjacent flap, as doing so helps bury the relatively sharp corner on the adjacent flap in the folded assembly. Alternatively or in addition, the corner on each flap may itself be rounded. These and other variations will be obvious to those skilled in the art.

Figure 8:
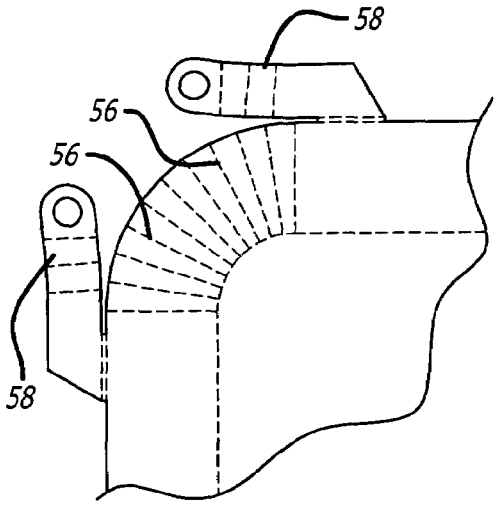
FIG. 8 is an illustration showing the corner detail of an alternate embodiment of an unfolded tray in accordance with the present invention.
Figure 9:
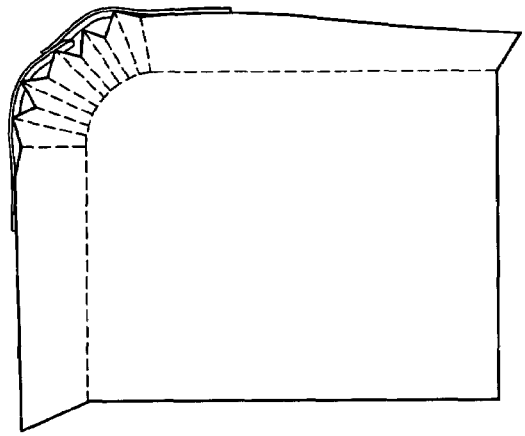
FIG. 9 is a bottom view of a folded tray showing the corner detail of FIG. 8 after folding.

The foregoing embodiment is well suited for containing and dispensing small, solid objects, but is not suitable for liquids because of the corner configuration used. However, FIG. 8 is an illustration showing the corner detail of an alternate embodiment of an unfolded tray, and FIG. 9 is a bottom view of a folded tray showing the corner detail of FIG. 8 after folding. This corner detail is leak proof, and accordingly, such a tray may be used with solid objects or liquids. The corner has a plurality of lines of reduced resistance to bending 56 separating the adjacent side areas which on folding, forms a pleated, leak proof corner construction. Tabs 58 integral with the side areas may be folded over to be outside the tray, and may be provided with cooperatively disposed complimentary snap fasteners for holding the sides and corners in the folded condition (FIG. 9). Preferably lines of reduced resistance to bending integrally join the tabs to the sides, and if desired, lines of reduced resistance to bending may be provided along the tabs as shown.

Figure 10:
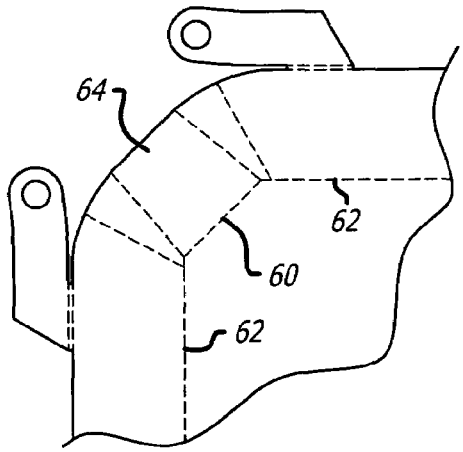
FIG. 10 is an illustration showing the corner detail of a still further alternate embodiment of an unfolded tray in accordance with the present invention.
Figure 11:
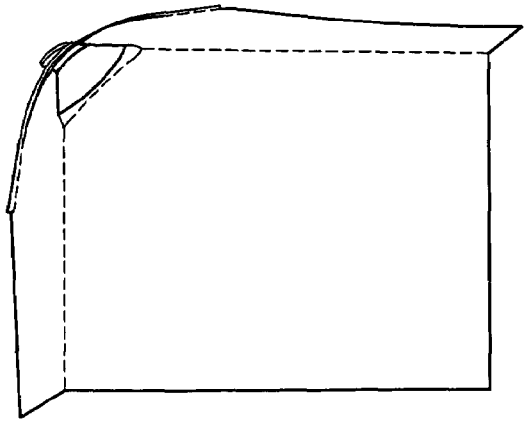
FIG. 11 is a bottom view of a folded tray showing the corner detail of FIG. 10 after folding.

A still further alternate embodiment of leak proof corner construction may be seen in FIG. 10 in the unfolded state, and in the folded state in FIG. 11. The corner construction has a corner panel or area 64 integrally coupled to the base area by a line of reduced resistance to bending 60 that is angled with respect to, and joins, the lines of reduced resistance to bending 62 joining the adjacent side areas to the base area. Two additional lines of reduced resistance to bending 66 are provided at each side of the corner area 64, which on folding of the tray, form a single pleat at each side of each corner area. Of course, one corner of either of these additional embodiments would preferably have the pouring spout hereinbefore described with respect to the first embodiment.

In the embodiments shown, a single pouring spout is shown. However more than one pouring spout might be provided, either identical to the first, such as, by way of example, at an opposite corner of the tray, or perhaps the same or similar in concept, but of different dimensions. For instance, one spout might be relatively wide and the other relatively narrow. This may be useful, by way of example, for pouring powders and materials of small particle size back into small mouth containers using the narrow spout, and using the same tray for larger items such as large beads and pouring the beads back into a larger mouth container using the wider spout. Also, if desired, the tabs 24 and 26 might be made wider, extending to or nearly to the corner 34 on one or more spouts. When the side areas are folded upward and the wider tabs folded over and joined, the spout will be covered, forming a sort of funnel to help facilitate spill proof pouring. Finally, while trays having four side areas are discussed, trays of a lesser or a greater number of side areas, each of the same or different sizes, may incorporate the principles of the present invention. By way of example, area 64 has been referred to herein as a corner panel, though the same could equally be considered another side panel, and could be produced in any relative size. Similarly, foldable trays having three sides are also provide practical implementations of the present invention.

One of the advantages of the present invention is that since the original tray is flat, the same will ship and store very efficiently, taking up little room at a retailer's display area or storeroom. In that regard, tab 56 (FIG. 1) is provided for hanging the tray on a common display rack found in most retail stores. This is to be compared with one piece molded trays which do not stack well or display easily, thereby increasing shipping costs and both display space and storage space. Typically such molded trays also do not include a turned up pouring spout like the present invention, and accordingly, the return of unused material in the tray to its original container, etc., is not as neatly and easily accomplishable as with the present invention. Thus, the present invention provides a very efficient, very useful and very practical tray for a myriad of uses.

What is claimed is:

1. A tray comprising:

a single sheet of material having a central base area and a plurality of side areas distributed around the base area, at least two adjacent side areas being bent upward along bend lines separating the two adjacent side areas from the base area that curve away from each other from adjacent a respective corner of the base area to cause the base area adjacent the respective corner to curve upward, each of the remaining side areas being bent upward along lines that do not curve away from each other and fastened to the adjacent side area at corners of the base area.

2. The tray of claim 1 wherein each side area is bent upward and fastened to the adjacent side area at corners of the base area that do not curve upward by cooperatively disposed male and female snap fasteners.

3. The tray of claim 1 wherein except for the bend lines separating at least two adjacent side areas from the base area being curved away from each other, the bend lines are substantially straight, and wherein die corners of the sheet of material defined by die intersection of substantially straight lines have a slit collinear with one of the bend lines and extending from a side of the sheet of material to another bend line, thereby defining a tab integral with a side area, the respective side areas being folded upward about the bend lines and the tabs fastened to the adjacent side areas.

4. The tray of claim 3 wherein the cooperatively disposed fasteners fastening the tabs to the adjacent side areas are snap fasteners.

5. The tray of claim 4 wherein the side areas bent upward along bend lines separating the respective side areas from the base area that curve away from each other adjacent the respective corner of the base area have cooperatively disposed corner tabs, the cooperatively disposed corner tabs being bent over the respective corner and fastened together.

6. The tray of claim 1 wherein the side areas bent upward along bend lines separating the respective side areas from the base area that curve away from each other adjacent the respective corner of the base area have cooperatively disposed corner tabs, the cooperatively disposed corner tabs being bent over the respective corner and fastened together.

7. The tray of claim 1 wherein a region joining adjacent side areas bent upward from the base area along bend lines that are straight adjacent a respective corner are pleated, and include corner tabs integral with the adjacent side areas and bent over a respective side area and fastened to an adjacent corner tab to hold the respective corner in the pleated condition.

8. The tray of claim 7 wherein the corner tabs are fastened by snap fasteners.

9. The tray of claim 1 wherein side areas bent upward along bend lines separating the respective side areas from the base area that are straight adjacent a respective corner each include a corner area between and integral with adjacent side areas, the corner area being bent to form at least one pleat at each side of the respective corner area.

10. The tray of claim 1 wherein the sheet is a plastic sheet.

11. The tray of claim 10 wherein the plastic is polyethylene.

12. The tray of claim 10 wherein the plastic is polypropylene.

13. The tray of claim 1 wherein the number of side areas is four.

14. The tray of claim 1 wherein the number of adjacent side areas coupled to the base area and bent along lines that curve away from each other adjacent a respective corner is two.

* * * * *